US006531822B1

(12) United States Patent
Vollkommer et al.

(10) Patent No.: US 6,531,822 B1
(45) Date of Patent: Mar. 11, 2003

(54) FLAT REFLECTOR LAMP FOR DIELECTRICALLY INHIBITED DISCHARGES WITH SPACERS

(75) Inventors: Frank Vollkommer, Buchendorf (DE); Lothar Hitzschke, Munich (DE)

(73) Assignee: Patent-Treuhand-Gesellschaft fuer elektrische Gluehlampen mbH, Munich (DE)

( * ) Notice: Subject to any disclaimer, the term of this patent is extended or adjusted under 35 U.S.C. 154(b) by 0 days.

(21) Appl. No.: 09/673,620

(22) PCT Filed: Apr. 9, 1999

(86) PCT No.: PCT/DE99/01092

§ 371 (c)(1),
(2), (4) Date: Oct. 19, 2000

(87) PCT Pub. No.: WO99/54916

PCT Pub. Date: Oct. 28, 1999

(30) Foreign Application Priority Data

Apr. 20, 1998 (DE) ..... 198 17 480

(51) Int. Cl.[7] ..... H05B 41/00
(52) U.S. Cl. ..... 313/634; 315/58; 315/324
(58) Field of Search ..... 313/634; 315/58, 315/324; 350/345

(56) References Cited

U.S. PATENT DOCUMENTS 4,945,281 A 7/1990 Ipson

FOREIGN PATENT DOCUMENTS

| | | |
|---|---|---|
| DE | 195 26 211 | 1/1997 |
| DE | 196 36 965 | 3/1998 |
| EP | 0 363 832 | 4/1990 |
| EP | 0 521 553 A2 | 1/1993 |
| JP | 03225743 | 10/1991 |
| JP | 06096732 | 4/1994 |
| JP | 07335177 | 12/1995 |
| JP | 09073877 | 3/1997 |
| WO | 94/23442 | 10/1994 |
| WO | WO 98/43276 | 10/1998 |

OTHER PUBLICATIONS

Takahiro Urakabe, Shigeki Harada, Takeo Saikatsu and Masao Karino, "A Flat Fluorescent Lamp with Xe Dielectric Barrier Discharges", Jun. 17, 1996, PP 20–25, "The 7th International Symposium on the Science & Technology of Light Sources", Advanced Technology R&D Center, Mitsubishi Electric Corporation, Hyogo 661, Japan.

Rich Hicks and Wes Halstead, "Flat Lamp Technology for LCD's ", 1994, PP 311–319, SPIE vol. 2219 Cockpit Displays, Lockheed Sanders, Avionics Division, New Hampshire 03061 (no month).

Thomas Electronics, Inc., "Flat Fluorescent Lamps for LCD Backlighting", Feb., 1996, 6 pages, Wanye, New Jersey 07470.

*Primary Examiner*—Vip Patel
*Assistant Examiner*—Ken Berck
(74) *Attorney, Agent, or Firm*—Robert F. Clark

(57) ABSTRACT

The invention relates to a flat reflector lamp for dielectrically inhibited discharges (14). Greater configuration flexibility is achieved in electrode design (11, 12) while simultaneously ensuring stability of the discharge vessel (1, 2) and preserving the possibility of minimum light reflection impairment by mounting the spacers (3) separated from the flat reflector frames (15) between the base plate (1) and the cover plate (2), the latter being arranged between the electrode strips (11, 12).

13 Claims, 4 Drawing Sheets

FLAT REFLECTOR LAMP FOR DIELECTRICALLY INHIBITED DISCHARGES WITH SPACERS

The present invention relates to a flat radiator lamp for dielectric barrier discharges, which can be used, in particular, for backlighting of display devices, principally liquid crystal display screens.

As regards the prior art, reference may be made firstly to the following applications of the same applicant, which form the technical basis for the following invention, and whose disclosure is included here:

DE 196 36 965.7=WO 97/01989

DE 195 26 211.5=WO 97/04625 and

DE-P 43 11 197.1=WO 94/23442.

In accordance therewith, there are known for dielectric barrier discharges flat radiator lamps in the case of which the discharge vessel filled with a gas fill consists essentially of a base plate and a cover plate which are connected by a frame. In this design, the spacing between the two plates is conspicuously smaller than their width and length.

The frame need not necessarily in this case be designed as a separate component, but is defined in the case of this invention by the fact that it outwardly seals the discharge volume, filled up by the gas fill, in the plane of the plates and between them. For example, the frame can also be formed by a cambered outer edge one of the two plates such that, to a certain extent, the frame forms the edge of a trough whose flat middle part is the base plate or cover plate.

Also known from the third printed publication mentioned above are spacers which support the two plates of the discharge vessel with respect to one another, but are intended in this prior art to bear or contain the electrodes of the lamp (compare FIGS. 4*a* and 4*b*).

EP 0 521 553 A2 may also be mentioned as prior art; it exhibits a flat gas discharge lamp with a reduced-pressure fill, which is protected against implosion by the stability of walls of the base and cover plates which are of sufficiently thick dimension.

Furthermore, this document shows the possibility of buffer gas fills for producing an atmospheric pressure of the gas fill, as is also shown by the publication entitled "A Flat Fluorescent Lamp With Xe Dielectric Barrier Discharges" by T. Urakabe, S. Harada, T. Saikatsu and M. Karino (Special Issue "The Seventh International Symposium on the Science & Technology of Light Sources" J. Light & Vis. Env., Vol. 20, No. 2, 1996, pages 20–25).

Spacers in the form of ribs, respectively traversing virtually the entire width of the flat reflector, between the plates, which use alternating cutouts to define in relation to a frame of the discharge vessel a discharge channel of overall meandering shape for a conventional Hg discharge are disclosed in "Flat Lamp Technology for LCDs" by R. Hicks and W. Halstead, SPIE, Volume 2219, Cockpit Displays (1994). The precise cross section and dimensions of length of the discharge channel defined by these spacers are essential for the—so-called wall-stabilized—Hg discharge.

Comparable examples from the commercial prior art are disclosed in data sheets of the manufacturer Thomas Electronics, Inc. (100 Riverview Drive, Wayne, N.J. 07470) "Flat Fluorescent Lamps for LCD-Backlighting".

Finally, the second printed publication cited at the beginning discloses an electrode arrangement in which the anodes and cathodes are of strip-type design and arranged on the base plate parallel to one another in an alternating fashion, that is to say offset from one another.

This invention is based on the technical problem of improving a flat radiator lamp of the type represented at the beginning with regard to stability and light-emitting properties.

In a somewhat more general formulation than at the beginning, the inventive solution of this problem is therefore based as preamble on a flat radiator lamp for dielectric barrier discharges having a discharge vessel, which is filled with a gas fill and has an essentially flat base plate, an essentially flat and at least partially transparent cover plate, a frame connecting the plates and at least one spacer supporting the two plates with respect to one another, and having anodes and cathodes which are at least partially of strip type and are arranged substantially offset in parallel with one another in a projection on a flat plane, a dielectric layer being arranged between the anodes and the gas fill.

In this case offset in parallel means that an adjacent, essentially parallel cathode strip piece essentially exists for each anode strip piece and vice versa.

The invention solves this technical problem by virtue of the fact that the spacer is completely separated from the frame by an interspace and is arranged in the projection between the electrode strips at least with its seating surfaces with the plates—or else entirely.

Consequently, the invention proceeds from the conventional concept of spacers which are connected as ribs on at least one side to the frame of the discharge vessel. According to the invention, it has been realized, rather, that an adequate stabilizing effect of the spacers is also possible when the spacers are connected only to the plates, but not directly to the frame. Specifically, the important loads occur perpendicular to the planes of the plates such that there is no need for the spacers to be straight and to be anchored on the frame.

Moreover, in the case when a spacer is connected to the frame the problem also arises that obscurations accumulate at the contact point owing to the absorption in the frame and the spacer and owing to the radiation component lacking from the corresponding part of the discharge vessel. The obscuration problem of a spacer or the frame can be countered per se in each case by suitable measures. Reference may be made in this regard to the parallel application "Leuchtstofflampe mit Abstandshaltern und lokal verdünnter Leuchtstoffschichtdicke" ["Fluorescent lamp with spacers and locally thinned fluorescent layer thickness"], whose disclosure is included here in relation to possible solutions in this regard. However, when spacers and frame meet at the contact point it becomes very difficult to compensate for the obscuration. This aspect plays a particular role in the case of the preferred field of application of this invention, specifically flat radiator lamps for background lighting of flat display devices, in particular liquid crystal display screens.

A further advantage of the invention is in this case the good gas flow dynamics inside the discharge vessel in the case of evacuation during the production process. Thus, for the purpose of cleaning and filling a lamp according to the invention, instead of the conventional vacuum furnace method (not represented here in more detail) it is also possible to use solutions with exhaust tubes in the case of which the discharge vessel is exhausted via the exhaust tube with the aid of a vacuum pump accompanied by heating (possibly locally progressing in the case of large lamps), and is then filled via the exhaust tube. The essential disadvantage of the vacuum furnace solution consists, in particular, in the substantial outlay in the case of large-size lamps which are of great technical interest, in particular in conjunction with a relatively large display device, and can also be produced relatively easily with the aid of the technology, employed here, of flat radiator lamps with dielectric barrier discharge.

Furthermore, the spacers according to the invention have the advantage that, by renouncing the continuous rib geometry in connection with the frame, it is possible to find "local solutions" for spacers which can be adapted to the geometric design of the electrode structure. Particularly in the context of optimizing the uniformity of light emission with regard to the abovementioned application areas, it is necessary to have the maximum possible freedom available when designing the electrode geometry.

Surprisingly, according to the invention it has been found that the electrode geometry, depending on the geometric size of the desired spacers, can be designed taking little or virtually no account of the local positions of the spacer(s). Contrary to expectation, it has also emerged that arranging spacers in positions which are exposed to strong fields between the electrodes does not cause any problems. In particular, highly symmetrical electrode geometries which fill the entire plane of the discharge vessel (in the projection) uniformly with partial discharges can be used. It is also possible for the spacers to be positioned substantially freely according to mechanical criteria without the electrode structure having to be greatly adapted.

With regard to the details of the geometric design of the electrode structures and the way in which they are adapted to the discharge vessel geometry, reference is made to the content of the disclosure in this respect of the following parallel applications in the name of the same applicant:

"Flachleuchtstofflampe für die Hintergrundbeleuchtung und Flüssigkristallanzeige-Vorrichtung mit dieser Flachleuchtstofflampe" [Flat fluorescent lamp for background lighting and liquid crystal display device having this flat fluorescent lamp] (file No. PCT/DE98/00827), "Flachstrahler" [Flat radiator] (file No. 197 11 892.5), "Gasentladungslampe mit dielektrisch behinderten Elektroden" [Gas discharge lamp with dielectric barrier electrodes] (file No. PCT/DE98/00826), which is included herein.

As is revealed in DE-P 43 11 197.1, which has already been cited in the introduction, the inventors initially worked on the assumption that providing spacers requires the electrode configuration to be adapted to the spacer geometry. Accordingly, even with electrode arrangements on or in the plates, for example in DE 195 26 211.5, it was to be expected that when introducing spacers it is necessary to leave large-area gaps between the individual partial surfaces of the electrode configuration, in order not to disrupt the field distribution and the undisrupted formation of the desired dielectric barrier discharges (cf. FIG. 6*a* of the cited application).

It is known that the dielectric barrier discharges at the dielectric layers lead to the formation of complicated space-charge systems which vary over the course of time. Together with the supply potentials applied, these lead to complex field intensity arrangements which change over the course of time, specifically even in regions which at first glance could appear to be free from fields. Initially, considerable disruptive interactions between spacers and these electric fields which change over the course of time were expected.

In particular, it was possible to work on the basis that arranging spacers in spaces which were not free from fields or directly between electrode strips leads to considerable inhomogeneities or contracted discharge channels resulting from an effective shortening of the discharge length, i.e. from a capacitive "short circuit" caused by the displacement current in the generally dielectric material of the spacer.

The problem was also anticipated that the surface areas of spacers, which are not inconsiderable when compared to the electrode strips, on account of capacitive coupling to electrode potentials, could lead to considerable increases in the effective surface area of certain electrodes and therefore could to a certain extent draw discharges towards themselves.

The surprising discovery on which this invention is based is that when the dielectric discharges are formed, the electrical mode of operation which is explained in detail in DE-P 43 11 197.1 (once again included herein) leads, as it were, to a "memory function" for the typical partial discharge structures being produced. This memory function has not only a temporal component but also a location component, meaning that the pulses of the active-power input, which are separated from one another by dead times, lead to individual partial discharges being reignited at preferably the same locations, presumably because, in the sense of a temporal memory function, residual ionization distinguishes these locations ahead of adjacent locations.

However, the partial discharges surprisingly carry an "independent physical life", which is substantially decoupled from conventional gas discharges and can scarcely be disrupted by the addition of spacers in a virtually immediately adjacent position.

In the same way as the term "frame" is defined functionally in the context of the present invention, this also applies to the term "spacer". In concrete terms, this means that the spacer does not necessarily have to form a component which is separate from the base plate (or cover plate). Rather, it is also possible, for example, to produce a base plate by shallow recesses with projections which have been left behind in these recessed areas to form the spacers. In particular, the discharge vessel of a flat radiator lamp according to the invention may also comprise essentially two main components, namely a base plate, at which the frame and spacer have already been formed out integrally, and a cover plate. This can be achieved by deep-drawing or pressing processes, by sand-blasting and using other methods.

One embodiment of the invention makes use of electrode structures which fix the local distribution of the partial discharges over and beyond the determining effect provided by the geometry of the electrode strips. Structures of this type are disclosed, inter alia, in D 196 36 965.7, which has already been cited and to which reference is made in this context. Protrusions on the cathodes, variations in the layer thickness of the dielectric, changes in the width of the electrodes, etc., are suitable, inter alia.

In this context, preference is given to those distributions of the electrode structures and therefore of the partial discharges which form an alternating sequence on both sides of a cathode strip. In this context, it should firstly be noted that the terms "cathode" and "anode" used in this application are to be understood as functional terms, meaning that when a lamp according to the invention is operated in bipolar mode, the electrodes alternately perform the anode function and the cathode function and therefore in such cases the statements which the present application makes in relation to anodes or cathodes must be regarded as applying to all electrodes. Therefore, if, in the case of an alternating sequence of partial discharges, one or more spacers are to be installed, according to the invention initially almost all arrangements between the partial discharges in which there is no direct overlap between the spacer and a partial discharge are possible. However, according to the invention it has proven particularly advantageous for the spacers, seen in the strip direction, to be arranged at the level of a partial discharge, but or the other side.

In this case, it should additionally be noted, for the case of unipolar operation, that the partial discharges, in terms of their compatibility with an adjacent spacer, have a direction which runs from the cathode to the anode. This means that a spacer arranged at the "rear" in terms of this direction of the partial discharges can be arranged particularly close to the partial discharge without having a disruptive effect.

In principle, however, other arrangements of the spacers are also suitable, for example between the partial discharges but not in the centre, but rather between the abovementioned level of the partial discharge on the opposite side and an adjacent partial discharge on the side of the spacer. Finally, it is also possible to use arrangements at locations which do not lie in a strip containing partial discharges between electrodes, but rather, for example, between two individual anodes of a "twin anode" which is of double design (cf. applications "Flachstrahler" [Flat radiator] and "Gasentladungslampe mit dielektrisch behinderten Elektroden" [Gas discharge lamp with dielectric barrier electrodes]). In this context, reference is made to the description of the exemplary embodiments.

In connection with the interspaces which are provided according to the invention between the spacers and the frame of the flat radiator discharge vessel, the stabilizing action of the spacers can be optimized by the latter dividing the lateral dimensions of the discharge vessel essentially into equal segments. In concrete terms, this means that when a spacer is used, the latter is arranged approximately in the centre of the area of the flat radiator, two spacers divide the correspondingly greater length of the flat radiator into segments of a third, etc., and similarly for two-dimensional spacer arrangements.

The resultant interspaces between the spacers should be of a certain size in the context of the invention, particularly the interspaces with respect to the frame. It is preferable for the interspaces to be more than one times, preferably more than twice, the spacing between the cover plate and the base plate.

Another parameter which is important for the invention can also be scaled on the basis of the spacing between the plates. That one of the two plates which forms the light-emitting side has already been referred to in the introduction as the cover plate. To reduce optical impairment to the light emission via this cover plate, a further idea of the invention consists in minimizing the size of the seating surface between the spacer and the wall under consideration. Although this is countered by mechanical considerations, namely the aim of avoiding punctiform loading on the wall (which is generally made from glass) caused by the spacer, this drawback is accepted in favour of minimizing the area which is obscured or can be lightened by a reduction in the layer thickness. In this context, it is preferable for this seating surface to be restricted to two dimensions, i.e. to be smaller in any conceivable direction in this plane. On the other hand, there are cases, particularly in the case of spacers which run in a line, in which it is advantageous for the seating surface to be restricted in only one direction (perpendicular to the spacer line).

In more concrete terms, this means that spacers which have more or less "punctiform" seating surfaces on the cover plate can be limited by restricting this seating surface in all directions. However, according to the invention this is not absolutely necessary, but rather it is also possible for "linear" seating surfaces to occur, for example as a result of cylindrical or prismatic spacers, which are then made sufficiently narrow in at least one direction.

Quantitative characterization of this restriction to the seating surface is suitably based on the spacing of the discharge vessel which is spanned by the spacer, i.e., for example, on the spacing between the plates of a flat radiator fluorescent lamp. In this case, the described small size of the seating surface should amount to less than 30%, preferably less than 20% or 10% of this spacing.

A further advantageous configuration of the invention relates to the stability of the discharge vessel with the spacers in the case of thermal cycles, such as those which almost inevitably occur in operation of the lamp. When developing the invention, it has proven essential for the coefficient of thermal expansion of the various main components of the discharge vessel and of the spacers to be adapted to one another. In particular, the coefficient of thermal expansion of the spacers should be in the range of ±30% of the coefficient of expansion of the main components of the discharge vessel. The main components of the discharge vessel are taken as meaning those components whose thermal expansion is significant for the thermal expansion of the overall discharge vessel on account of their geometric dimensions and their function in the discharge vessel. In the case of a flat radiator, these are, for example, the two plates and the frame connecting the two plates. Incorrect matches in this region, depending on the level of thermal loads in the operation, lead to internal stresses and movements of the vessel constituents and the spacers with respect to one another and therefore instability and to connections becoming detached, until the lamp breaks.

Soft glass materials have proven suitable for the spacers. Soft glass materials of this type can also be used in a refined form of the materials, e.g. as powder held together by a binder or soldering glass. Finally, various ceramic materials, in particular $Al_2O_3$ ceramic, are suitable. With regard to the question of which material is selected and of the coefficients of expansion, reference is made to the parallel application "Leuchtstofflampe mit Abstandshaltern und lokal verdünnter Leuchtstoffschichtdicke" [Fluorescent lamp having spacers and a locally thinned fluorescent thickness], which has already been cited.

With a view to the abovementioned minimization of the seating surface of the spacer on the transparent area of the wall, it has emerged that a fixed connection between spacer and wall is not necessarily advantageous. Rather, it may be advantageous for the spacer to be attached only towards the other side, i.e. on the opposite wall, so that it is fixed throughout the entire assembly. As a result of a suitable geometric design, the wall with the transparent area then simply rests on the spacer, without any further connecting materials, such as soldering glass materials, adhesives or the like, being provided. Consequently, the seating surface can be restricted to a minimum.

Furthermore, this also offers a benefit in terms of any differences in thermal expansion between the two walls connected by the spacer. In the event of transverse displacements caused as a result, the wall which is only resting against the spacer can slide with respect to the spacer before excessive stresses occur.

A further possible option for reducing the optical disruption caused by an image of the spacer consists in cladding the latter with a fluorescent coating. As a result, the spacer no longer appears, or appears to a lesser extent, as a shadow on the other side of the transparent wall, apart from in the direct region of contact between spacer and wall. Too little ultraviolet light reaches that region to significantly excite the phosphor.

Since the fluorescent cladding of the spacer increases the seating surface on the wall, it should be clarified that as a result of the fluorescing of the fluorescent layer the region of contact between the fluorescent layer and the wall does not appear as a shadow to the same extent as the uncoated spacer wherever sufficient ultraviolet light is available for excitation purposes. Accordingly, the seating surface which is to be deemed effective in the context of the above explanations aimed at minimizing the seating surface is that of the spacer without the fluorescent layer (or only with insufficiently excited regions of the fluorescent layer).

Another option for lighting the vicinity of the spacer consists, according to the invention, in a reflecting coating of a region of the spacer which faces the transparent wall. This intensifies the introduction of the light which is diffusely distributed inside the discharge vessel into that region of the fluorescent layer on the wall which has been thinned according to the invention.

Hitherto, the function of the spacers was always considered to be that of stabilization. In this case, however, it is possible to draw a distinction: the geometry of flat radiator lamps means that they are mechanically endangered from two significant directions. Firstly, flat, large-area discharge vessels are at risk of breaking as a result of bending loads. This is a consequence of the lever actions which arise.

Even in this respect, the invention offers a significant improvement, in that the corresponding stabilization of the discharge vessel can be achieved without significant restrictions on the arrangement of the electrodes and the uniformity of the light emission.

A further aspect is the implosion of flat radiator lamps containing a reduced-pressure gas fill. Since, according to the invention, it is now possible to produce a discharge vessel which is stable even with regard to the risk of implosion without being excessively restricted in other areas of the lamp design (see above), reduced-pressure gas fills are to be regarded as preferable for the invention. They avoid the need for additions of buffer gas in order to produce an internal pressure in the discharge vessel which is matched to the external atmospheric pressure. As a result, possible technical drawbacks caused by the additions of buffer gas are avoided and a suitable technical alternative is created.

A final important aspect of the invention is the surprising suitability of the electrode structures for high voltages despite the spacers arranged in the vicinity. Suitability for high voltages with regard to the amplitudes of, for example, a pulsed electrical supply may be of interest with a view to increasing the efficiency of the lamp. This relates in particular to the application for background lighting for liquid crystal displays which absorb a large proportion of the light emitted by the lamp.

In fact, it has emerged during the work carried out on this invention that short spacings between the electrodes which are required at relatively low voltage amplitudes have an adverse effect on this efficiency. The same applies if the pressure of the gas fill is lowered excessively. Finally, particularly in the case of the pulsed operating mode, only short times are available for the introduction of active power, and consequently relatively high voltages are achieved in order to achieve a high time-averaged lamp output.

In this context, the invention is preferably aimed at flat radiator lamps designed for supply voltage amplitudes of at least 600 V, particularly preferably 800 V or 1000 V or 1200 V.

To explain the invention, exemplary embodiments of the invention are described in more detail with reference to the figures. Details disclosed in these exemplary embodiments may also be essential to the invention in other combinations. In detail:

Figure 1:
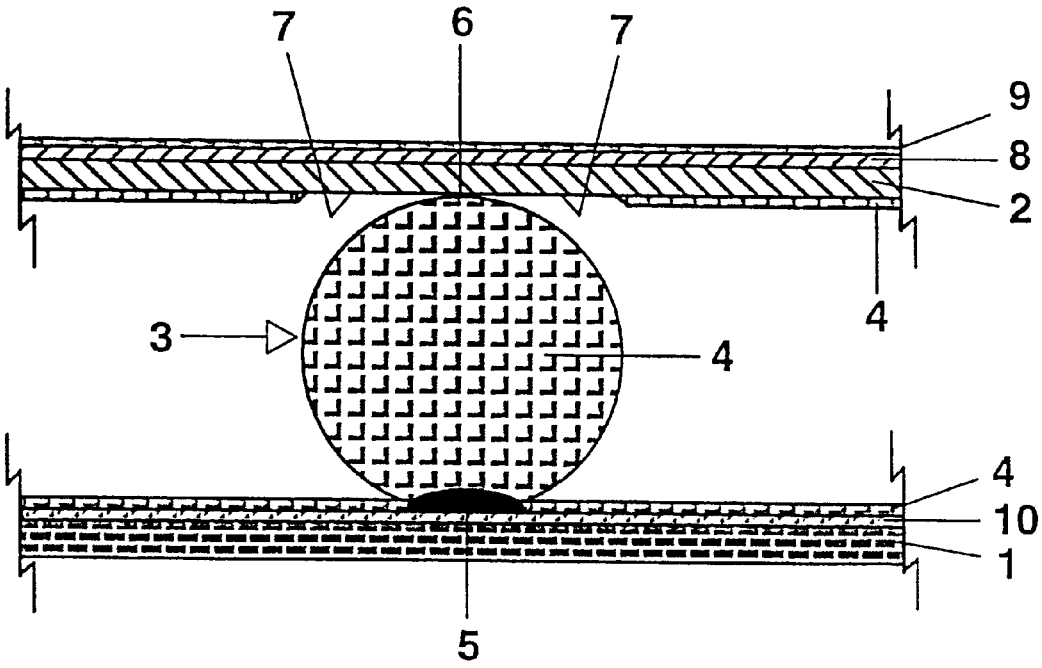
FIG. 1 shows an excerpt view which forms a cross section through a spacer between base plate and cover plate in a plane which is perpendicular to the planes of a base plate and cover plate.

FIG. 1 illustrates a typical example or a spacer according to the invention viewed as an excerpt and in cross section. In this case, a precision glass bead 3 made from soft glass and having a diameter of 5 mm lies between a base plate 1 and a cover plate 2 of a flat radiator lamp.

Apart from soft glass, other dielectric materials, e.g. ceramics or other glass materials, are also suitable, as are materials which are based on glass powder or ceramic powder and additionally contain a binder or the like, e.g. soldering glass. However, in addition to the dielectric properties, the coefficients of thermal expansion, which have already been discussed elsewhere in the text, constitute another significant aspect.

The glass bead 3 is coated with a fluorescent layer 4 which is also to be found on the base plate 1 and on the cover plate 2.

In this case, the glass bead 3 is soldered onto the base plate 1 by means of a soldering glass in the region 5, so that it is fixed during assembly. It is only resting against the cover plate 2. Around this seating surface 6, the fluorescent layer 4 of the cover plate 2 has been removed in a certain region 7.

A thin cased opal layer 8 is formed on the outer side of the cover plate 2, which consists of transparent special glass B270 produced by DESAG, and a prism film 9 (brightness enhancement film produced by 3M) rests on this cased opal layer.

Furthermore, a reflecting layer 10 is situated beneath the fluorescent layer 4 on the base plate. For further details in this respect, reference is made to the application "Leuchtstofflampe mit Abstandshaltern und lokal verdünnter Leuchtstoffschichtdicke" [Fluorescent lamp having spacers and a locally thinned fluorescent layer thickness] which has already been cited and which shows a similar figure.

Figure 2:
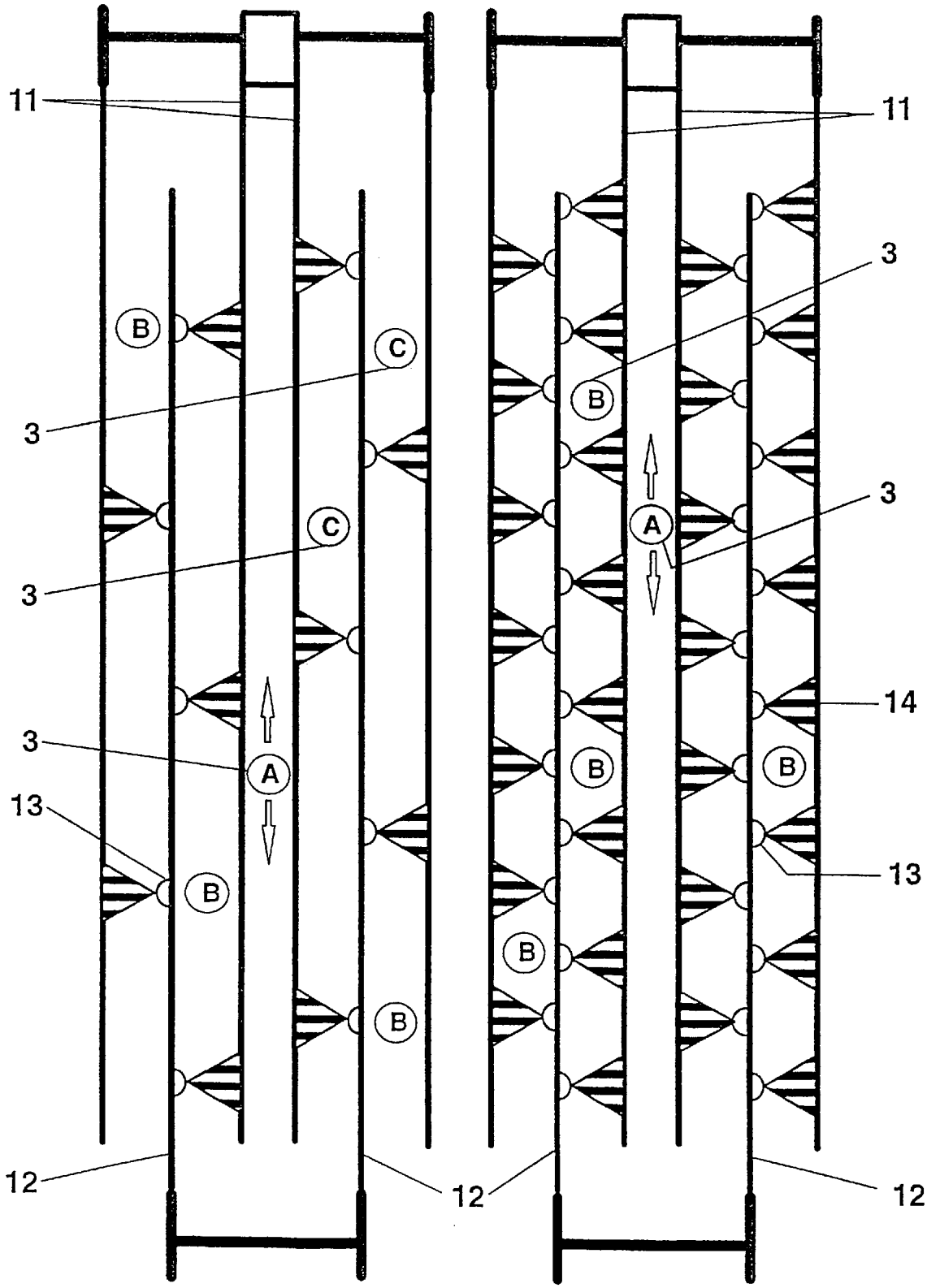
FIG. 2 shows three different variants of the arrangement of a spacer of this type in a typical electrode structure of a flat radiator lamp.

FIG. 2 now illustrates three different variants, denoted by letters A, B and C, of the arrangement of a spacer 3 of this type in a typical electrode configuration of a flat radiator lamp, in connection with which reference is further made to the application "Gasentladungslampe mit dielektrisch behinderten Elektroden" [Gas discharge lamp having dielectric barrier electrodes].

In FIG. 2, the electrodes illustrated correspond to a projection on a flat plane. FIG. 2 therefore does not initially define whether the anodes 11 and the cathodes 12 are deposited on or in the same plate or on or in different plates.

The former option is preferable with a view to simplifying the production process and is illustrated, for example, in FIG. 6*a* of DE 195 26 211.5, which has already been cited. The latter case has certain advantages, in connection with which reference is made to FIG. 9*b* of the application "Gasentladungslampe mit dielektrisch behinderten Elektroden" [Gas discharge lamp having dielectric barrier electrodes], which has also already been cited. If FIG. 2 of the present application is considered not as a plan view but rather as a projected illustration, it is valid for both cases.

Furthermore, the right-hand and left-hand halves of the illustration shown in FIG. 2 represent two electrode configurations which differ to the extent that the spacing between the lug-like protrusions 13 on the cathodes 12 has been quadrupled (cf. DE 196 36 965.7). The delta-shaped partial discharges are denoted by 14.

First of all, A shows a possible option in which the glass bead 3, in the projection, rests on a flat plane between the individual anodes of a twin anode arrangement 11. On account of the abovementioned reasons of the complicated space-charge distributions which change over the course of time on the dielectric layers, at least on the anodes, this region is in no way actually free from fields. Rather, the discharges between the cathodes 12 associated with the respective individual anodes and these individual anodes are never actually symmetrical. However, compared to positions B and C between the electrodes of different polarities, which are yet to be explained below, it could be expected that the difficulties would be least in this position. In actual fact, this position A is also a possible position, and the glass bead 3 can be positioned substantially arbitrarily in the vertical direction in FIG. 2, which is indicated by the arrows.

Surprisingly, however, the second option B which is illustrated emerges as the variant which is preferred in the context of the present invention, with the glass bead 3 to some extent being positioned in the rear of a lug-like protrusion 13 between a cathode 12 and an individual anode of the twin anode 11.

For relatively great distances between the lug-like protrusions 13, as illustrated in the left-hand half of FIG. 2, there is additionally a position C which differs from position B. This position could appear less problematical compared to B, since the glass bead 3 comes relatively close to the partial discharge 14 on the immediately adjacent lug-like protrusion 13 towards the other side of the cathode 12. This is not true for position C. However, it has emerged that the "sensitivity" of the partial discharges 14 with regard to a spacer 3 coming excessively close is not isotropic in the two-dimensional plane of the drawing. Rather, it has emerged that the partial discharge 14 to a certain extent "looks" away from the protrusion 13 towards the adjacent anode. In concrete terms, this means that if the spacings between the electrode strips 11 and 12 are particularly narrow and if the spacing between the partial discharges 14 is in principle sufficient for an arrangement of the spacers 3 which corresponds to position C, position B has nevertheless proven more favourable.

Fundamentally, all the positions illustrated in this figure, as well as other, less symmetrical positions, are possible according to the invention. It is essentially necessary to prevent the spacers 3 and the direct discharge region of each partial discharge 14, which manifests itself as a visible Delta, forming an overlap. The associated sensitivity with regard to proximity between the spacers 3 and partial discharges 14 is, incidentally, also dependent on the voltage amplitudes used in the power supply. If the individual discharges in certain exceptional circumstances cannot be adequately located by means of their own illumination, they can still be found at least using their emission in the infrared or UV region.

Figure 3:
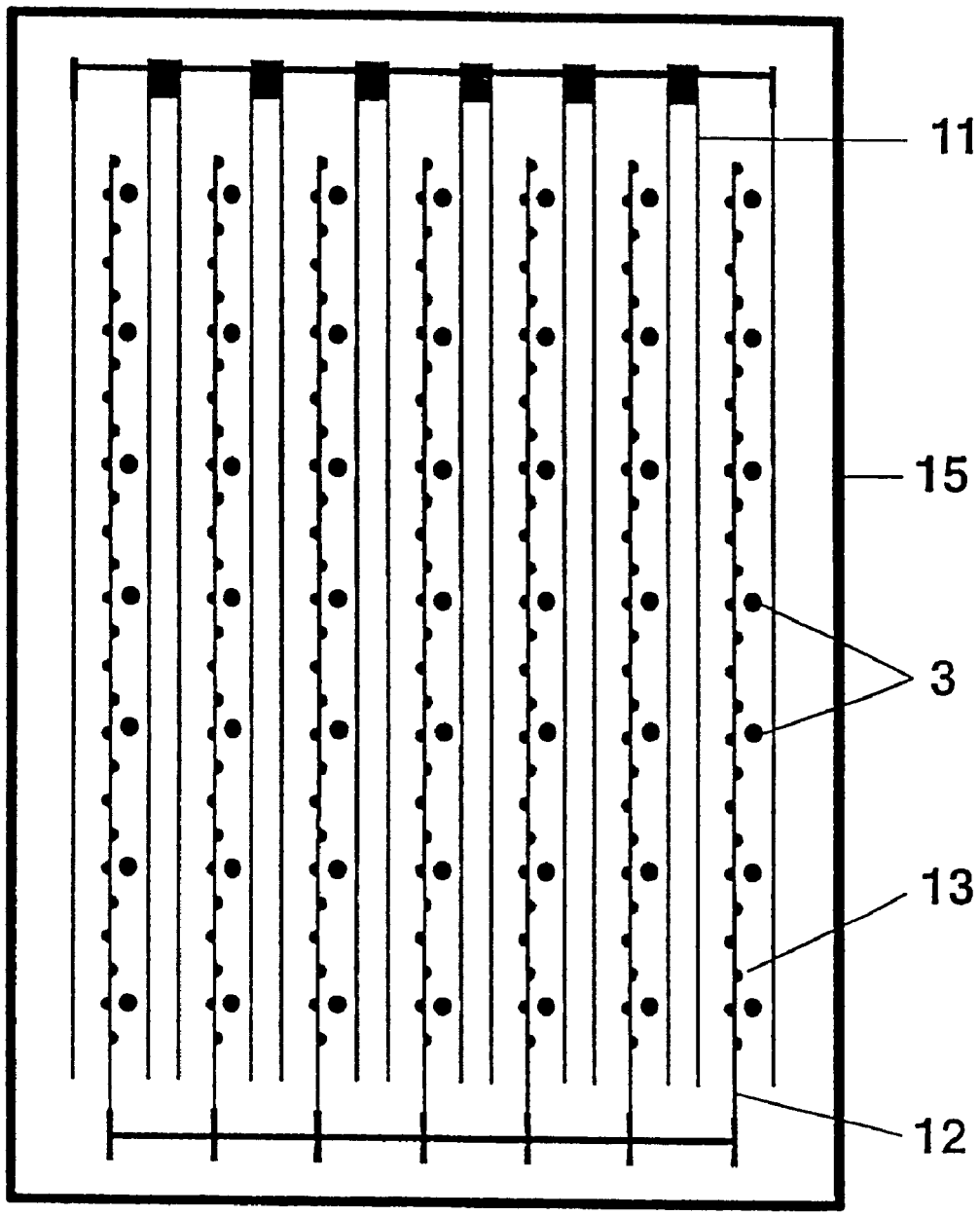
FIG. 3 shows an example of an arrangement of a pattern of spacers according to one of the variants illustrated in FIG. 2.

For illustration, FIG. 3 shows a case which largely corresponds to the right-hand half of FIG. 2 and in which the variant B is used for the arrangement of the spacer 3. In this figure, there are no longer any partial discharges 14 illustrated, but there is a complete arrangement of a greater number of 49 glass beads 3 which, in a substantially uniform distribution, form a pattern over substantially the entire region of a discharge vessel (not shown). In this pattern, the spacings between the outer glass beads 3 and the edges of the discharge vessel substantially correspond to the spacings between the beads, so that overall the width and length of the rectangular discharge vessel is divided into approximately uniform subunits.

This figure also shows a frame 15 of the discharge vessel. It can be seen that everywhere the spacers 3 are separated from one another and from the frame by more than twice their diameter and therefore more than twice the spacing between the plates.

In this case, a relatively large number of spacers have been used, since the electrode arrangement in FIG. 3 is designed to form a flat radiator lamp for the backlighting of a liquid-crystal display screen. In this context, weight aspects play an important role, and consequently the cover plate 2 and the base plate 1 have to be of relatively thin design.

Figure 4:
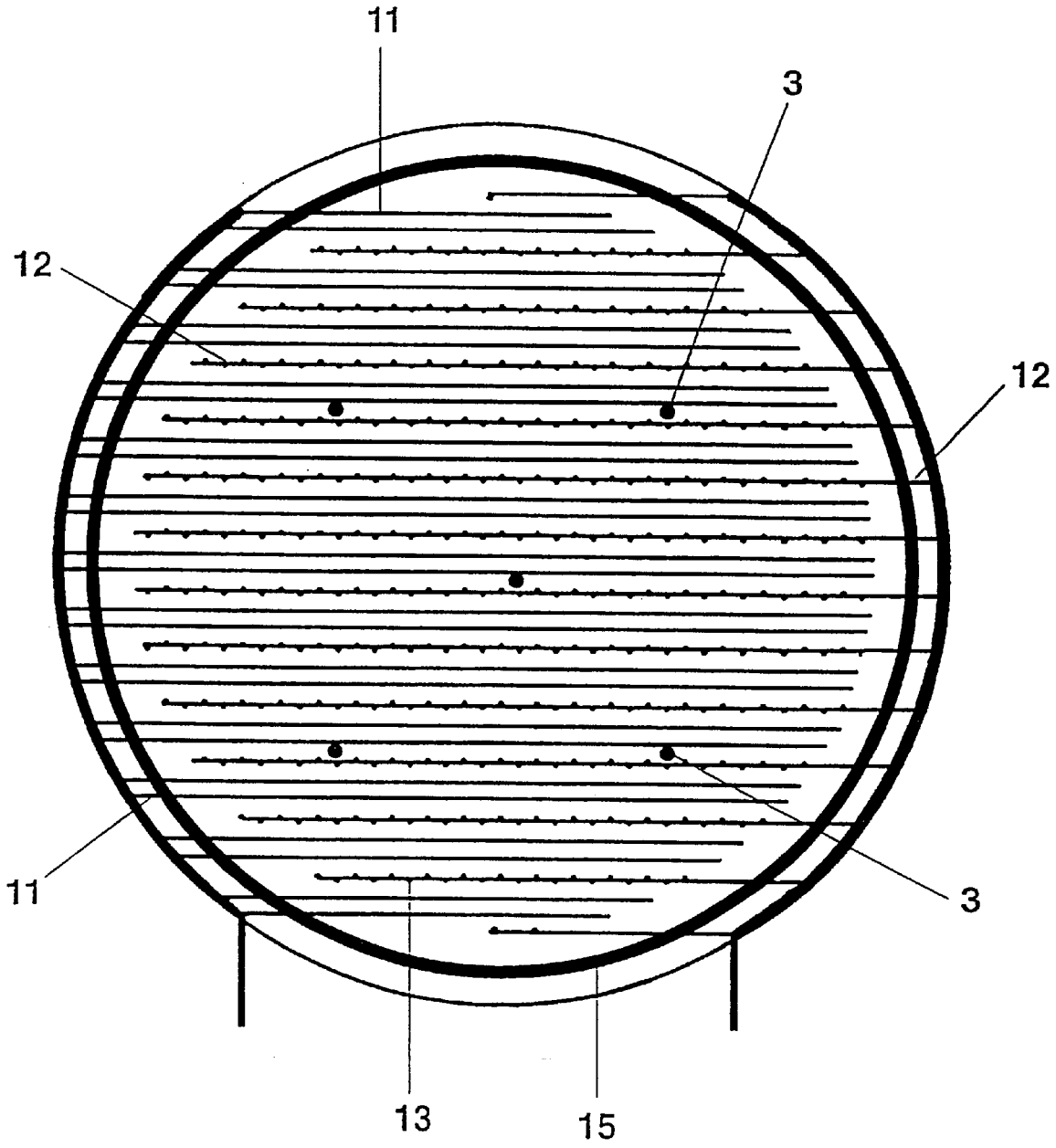
FIG. 4 shows an arrangement which is similar to FIG. 3, but for a different application.

A different exemplary embodiment is sketched in FIG. 4. In this figure, the spacings between the spacers 3 for a locally similar electrode structure are set further apart. This is because this figure shows an electrode structure for a flat radiator signalling lamp which is part of a set of traffic lights. In this application, the weight of the flat radiator lamp is of less decisive importance than in the previous application. In any case, the glass plates of the flat radiator lamp should be thicker than in a screen, in order to protect against environmental influences, impacts and the like. For this reason, the stabilizing effect provided by spacers 3 is not required to the same extent as in the previous exemplary embodiment. With regard to this application, reference is also made to the European application "Signallampe und Leuchtstoffe dazu" [Signalling lamp and phosphors therefor] bearing file No. 97122800.2, in the name of the same applicant.

The electrode structure is distinguished by a round, encasing overall shape. In this case, the frame 15 of the discharge vessel runs in the form of a circle between the bus-like electrode combinations on the right and left in FIG. 4 and the direct discharge region which can be seen from the lug-like protrusions 13. The area inside this frame is once again divided into substantially equal spacings by the illustrated arrangement of the spacers 3.

What is claimed is:

1. Flat radiator lamp for dielectric barrier discharges (14) having a discharge vessel, which is filled with a gas fill and has an essentially flat base plate (1), an essentially flat and at least partially transparent cover plate (2), a frame (15) connecting the plates and at least one spacer (3) supporting the two plates (1, 2) with respect to one another, and having anodes (11) and cathodes (12) which are at least partially of strip type and are arranged substantially offset in parallel with one another in a projection on a flat plane, a dielectric layer being arranged between the anodes and the gas fill, and having electrode structures (13) for spatially fixing partial discharges (14), characterized in that the electrode structures (11, 12) fix the partial discharges (14) in alternating sequence on both sides of a cathode strip, and the spacer (3) is completely separated from the frame (15) by an interspace and is arranged in the projection between the electrode strips (11, 12) at least with its seating surfaces with the plates (1, 2), and is arranged between the sites of fixed partial discharges and, in this case, between the sites of two partial discharges adjacent on the same side.

2. Flat radiator lamp according to claim 1, in which the spacer (3), seen in the strip direction, is arranged on the opposite side of this strip approximately at the level of a partial discharge.

3. Flat radiator lamp according to claim 1, in which the spacer(s) (3) divide the lateral dimensions of the discharge vessel essentially into equal segments.

4. Flat radiator lamp according to claim 1, in which the interspace is larger than the spacing between the plates (1, 2).

5. Flat radiator lamp according to claim 1, in which the seating surface between the spacer (3) and the cover plate (2) is narrower in area than 30% of the spacing between the plates (1, 2), at least in one direction.

6. Flat radiator lamp according to claim 5, in which the seating surface between the spacer (3) and the cover plate (1, 2) is narrower in area than 30% of the spacing between the plates, in all directions.

7. Fluorescent lamp according to claim 1, in which the spacer (3) has a coefficient of thermal expansion which, corresponds with a tolerance of ±30% to that of the main components (1, 2, 15) of the discharge vessel.

8. Fluorescent lamp according to claim 1, in which the spacer (3) consists essentially of soft glass, a material essentially containing soft glass, or a ceramic material.

9. Fluorescent lamp according to claim 1, in which the spacer (3) bears against the cover plate (2) without connecting material.

10. Fluorescent lamp according to claim 1, in which the spacer (3) has an external fluorescent coating (4).

11. Fluorescent lamp according to claim 1, in which the spacer has a reflecting coating in a region facing the cover plate.

12. Flat radiator lamp according to claim 1, in which the gas fill is at reduced pressure.

13. Flat radiator lamp according to claim 1, designed for supply voltage amplitudes of at least 600 V.

* * * * *